US011220660B2

(12) United States Patent
Sunder et al.

(10) Patent No.: US 11,220,660 B2
(45) Date of Patent: Jan. 11, 2022

(54) PORTION BAG HAVING BLEACH ACTIVATOR/COMPLEXING AGENT COMPOUND

(71) Applicant: Henkel AG & Co. KGaA, Duesseldorf (DE)

(72) Inventors: Matthias Sunder, Duesseldorf (DE); Frank Meier, Duesseldorf (DE); Sheila Edwards, Duesseldorf (DE); Ulrich Pegelow, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/421,785

(22) Filed: May 24, 2019

(65) Prior Publication Data

US 2019/0276779 A1 Sep. 12, 2019

Related U.S. Application Data

(63) Continuation of application No. PCT/EP2017/080015, filed on Nov. 22, 2017.

(30) Foreign Application Priority Data

Nov. 25, 2016 (DE) ..... 102016223472.2

(51) Int. Cl.

| | |
|---|---|
| ***C11D 3/60*** | (2006.01) |
| ***C11D 17/00*** | (2006.01) |
| ***C11D 3/33*** | (2006.01) |
| ***C11D 3/36*** | (2006.01) |
| ***C11D 3/39*** | (2006.01) |
| ***C11D 17/04*** | (2006.01) |
| ***C11D 17/06*** | (2006.01) |
| *C11D 11/00* | (2006.01) |

(52) U.S. Cl.

CPC ..... *C11D 17/0017* (2013.01); *C11D 3/33* (2013.01); *C11D 3/361* (2013.01); *C11D 3/364* (2013.01); *C11D 3/392* (2013.01); *C11D 3/3905* (2013.01); *C11D 3/3935* (2013.01); *C11D 17/0039* (2013.01); *C11D 17/044* (2013.01); *C11D 17/06* (2013.01); *C11D 11/0017* (2013.01); *C11D 11/0023* (2013.01)

(58) Field of Classification Search

CPC ..... C11D 17/003; C11D 17/0017; C11D 17/0039

USPC ..... 510/337, 349

See application file for complete search history.

(56) References Cited

U.S. PATENT DOCUMENTS

| | | | | |
|---|---|---|---|---|
| 2007/0197416 | A1* | 8/2007 | Pegelow | C11D 3/3935 510/302 |
| 2009/0130224 | A1* | 5/2009 | Borchers | C11D 3/3917 424/616 |
| 2009/0156454 | A1* | 6/2009 | Schmiedel | C11D 3/38672 510/302 |
| 2009/0192069 | A1* | 7/2009 | Schirmer-Ditze | C11D 3/3942 510/446 |
| 2011/0303576 | A1 | 12/2011 | Ricci et al. | |
| 2012/0297551 | A1 | 11/2012 | Grande et al. | |

FOREIGN PATENT DOCUMENTS

| | | | |
|---|---|---|---|
| DE | 2412837 | A1 | 10/1974 |
| DE | 19704634 | A1 | 8/1998 |
| DE | 102004012568 | A1 | 12/2005 |
| DE | 102007051093 | A1 | 4/2009 |
| DE | 102014202221 | A1 | 8/2015 |
| EP | 3190168 | A1 | 7/2017 |
| WO | 9403395 | A1 | 2/1994 |
| WO | 2005087908 | A1 | 9/2005 |
| WO | 2015118357 | A2 | 8/2015 |

OTHER PUBLICATIONS

Bender, Myron L. et al., "The Determination of the Concentration of Hydrolytic Enzyme Solutions: α-Chymotrypsin, Trypsin, Papain, Elastase, Subtilisin, and Acetylcholinesterase", Journal of the American Chemical Society, vol. 88, No. 24, Dec. 20, 1966, pp. 5890-5913.

International Search Report PCT/EP2017/080015 Completed: Feb. 28, 2018, dated Mar. 8, 2018 3 pages.

German Patent and Trademark Office, Research Report, dated Mar. 30, 2017, 6 Pages, Munich, Germany.

* cited by examiner

*Primary Examiner* — Gregory E Webb

(74) *Attorney, Agent, or Firm* — Bojuan Deng

(57) ABSTRACT

A bleach activator/complexing agent compound and multiphase washing and cleaning agents including at least one liquid, low-water to water-free phase and at least one solid, pulverous or granular phase and containing at least one bleach activator, which is compounded with at least one complexing agent. Also disclosed are methods of using such agents in washing and cleaning.

20 Claims, No Drawings

PORTION BAG HAVING BLEACH ACTIVATOR/COMPLEXING AGENT COMPOUND

FIELD OF THE INVENTION

The present invention relates to the bleach activator particles described herein which are compounded with at least one complexing agent, and to multiphase washing and cleaning agents which comprise at least one liquid, low-water to water-free phase and at least one solid, powder or granular phase and contain at least one bleach activator compounded with at least one complexing agent. The present invention is further directed to the use of agents of this kind, to washing and cleaning methods in which agents of this kind are used, and to corresponding washing methods.

BACKGROUND OF THE INVENTION

Washing and cleaning agents are available to the consumer in a plurality of product formats. In addition to the traditional solid agents, flowable and in particular liquid to gel agents have been playing an increasingly important role recently. The consumer especially appreciates the rapid solubility and the associated rapid availability of the ingredients in the washing and cleaning liquor, in particular even in short programs and at low temperatures.

Concentrated compositions, in which the water content is in particular reduced by comparison with conventional compositions, are becoming more and more important. Therefore, compositions of which the water content is as low as possible, for example less than 20 wt. %, are particularly desirable for the consumer.

Furthermore, consumers have grown accustomed to the convenient metering of preportioned washing and automatic dishwashing detergents and, to date, have primarily used these products in the form of tablets. In order to put a liquid washing or dishwashing detergent, which offers the above-mentioned advantages over solid compositions, in a preportioned product format, the use of cold-water-soluble films in the form of sachets is common.

BRIEF SUMMARY OF THE INVENTION

A high washing and cleaning performance is achieved primarily by a combination of liquid and powder phases in what are referred to as "multi-compartment sachets." A high washing and cleaning performance is also achieved by a combination of gel or pasty phases and powder phases in what are referred to as "single-compartment sachets." The bleach-active substance of the washing or cleaning agent is usually contained in the powder phase. While multi-compartment sachet systems of this kind are in storage, the various phases may undergo a chemical reaction, which in particular involves the degradation of the bleach-active substances. Specifically, this means that the bleach-active substances are activated, and then react with the water-soluble film and other ingredients, for example fragrances and dyes, which are contained in the liquid phase. This results in discoloration and odor changes to the product, as a result of which consumers' expectations as to the aesthetics of the product are not met. In addition, the loss of activity of the bleach-active substance causes an undesirable reduction in the washing performance. The same applies, mutatis mutandis, to the "single-compartment sachet."

Surprisingly, it has now been found that bleach activators compounded with complexing agents in the powder phase of a multiphase washing or cleaning agent bring about chemical stabilization of the entire sachet. This stabilizing effect is reflected in the fact that decomposition of the water-soluble film and color or odor changes to the agent no longer occur, even with longer storage times. In addition, agents of this kind have an improved washing or cleaning performance, in particular when the agent is stored for a relatively long time.

In a first aspect, the present invention is directed to the particles described herein, substantially comprising at least one bleach activator, characterized in that the at least one bleach activator is compounded with at least one complexing agent.

In a second aspect, the invention is therefore directed to a multiphase washing or cleaning agent, comprising at least one liquid, low-water to water-free phase and at least one solid, powder or granular phase, characterized in that the at least one solid, powder or granular phase contains at least one bleach activator, the bleach activator being compounded with at least one complexing agent.

In a further aspect, the present invention is directed to the use of the agent for washing textiles or cleaning hard surfaces, in particular for the automatic cleaning of dishes.

In yet another aspect, the present invention is further directed to a method for cleaning textiles or hard surfaces, in particular the automatic cleaning of dishes, characterized in that a washing or cleaning agent according to the invention is used.

These and other aspects, features, and advantages of the invention will become apparent to a person skilled in the art through the study of the following detailed description and claims. Any feature from one aspect of the invention can be used in any other aspect of the invention. Furthermore, it will readily be understood that the examples contained herein are intended to describe and illustrate but not to limit the invention and that, in particular, the invention is not limited to these examples.

DETAILED DESCRIPTION OF THE INVENTION

Unless indicated otherwise, all percentages are indicated in terms of wt. %. Numerical ranges that are indicated in the format "from x to y" also include the stated values. If several preferred numerical ranges are indicated in this format, it will readily be understood that all ranges that result from the combination of the various endpoints are also included.

"At least one," as used herein, refers to one or more, for example 1, 2, 3, 4, 5, 6, 7, 8, 9 or more.

In the context of this invention, the term "phase" denotes one portion of the agent which differs from another phase of the agent according to the invention, which contains at least two phases, on account of its different features, such as ingredients, physical properties, external appearance, etc. The phases differ in particular with respect to physical properties and in particular by the state of aggregation, with one phase preferably being liquid under standard conditions (1013 mbar, 20° C.), and the other preferably being solid under said conditions. Generally, terms such as "solid" and "liquid," as used herein, refer to the state of aggregation under standard conditions, as defined above.

The agent according to the invention has at least two different phases. Both the at least one first phase and the at least one second phase are described below. If the agent according to the invention has more than two phases, each further phase may correspond either to the at least one first phase, as defined herein, or to the at least one second phase, as defined herein. The compositions of the respectively corresponding phases may differ to the extent permitted by the respective definitions of both the at least one first phase and the at least one second phase as indicated below. For example, it may be a three-phase dishwashing detergent having two phases corresponding to the first phase, as defined herein, and one phase corresponding to the second phase, as defined herein. In the described agents, the different phases are packaged in such a way that they are spatially separated from one another, for example in different compartments of a multi-compartment sachet.

The term "low-water," as used herein, means that the composition described thereby contains 20 wt. % or less of water. In particular, this term covers compositions containing from 1 to 20 wt. % of water, from 1 to 15 wt. % of water, from 5 to 15 wt. % of water, or less than 15 wt. % or less than 10 wt. % of water.

"Water-free," as used herein, means that a composition contains less than 5 wt. %, in particular less than 3 wt. %, preferably less than 1 wt. %, of water.

The water content, as defined herein, refers to the water content as determined by Karl Fischer titration.

"Liquid," as used herein with respect to any of the at least two different phases of the washing or cleaning agents according to the invention, includes all flowable compositions, in particular also gels and pasty compositions. In particular, the term also includes non-Newtonian liquids having a yield point.

"Solid," as used herein with respect to any of the at least two different phases of the washing or cleaning agents according to the invention, includes all forms of flowable powder, granules, extrudates, etc., in particular those having a bulk density of from 300 g/l to 1200 g/1, in particular from 500 g/l to 900 g/1, or from 600 g/l to 850 g/1.

"Water-soluble" refers to the property of a substance or an object whereby it has a solubility in distilled water, measured at 25° C., of at least 0.1 g/l. In some embodiments, the substance and the object have a solubility of at least 0.1, at least 1, at least 5, at least 10, at least 50, at least 100, at least 500 g/1, measured at 25° C.

"Water-disintegrable" means that the substance or the object breaks into small parts upon contact with water at temperatures of between 15 and 60° C., and in particular between 20 and 45° C., within 15, preferably 10 minutes.

"Substantially," as used herein with respect to a feature of a substance or object, refers to the main feature of that particular substance or object. Thus, in the context of the present invention, it may refer to the material composition of an item, for example a composition, which contains the particular substance mentioned as its main component. Thus, with respect to the particles, as described herein, substantially comprising at least one bleach activator, the term means that the main component of the particles is at least one bleach activator, as defined herein. The composition (of the particles) may, however, also comprise one or more further components. However, in the context of the present invention, the particular main component, in various embodiments, is contained in the composition in an amount of no less than 50 wt. %, preferably no less than 55 wt. %, 60 wt. %, 65 wt. %, 70 wt. %, 75 wt. %, 80 wt. %, 85 wt. %, 90 wt. % or 95 wt. %. Moreover, in the context of the present invention, "substantially" may refer to a spatial definition of an item. With respect to the particles as described herein which, in various embodiments, may be, for example, "substantially" spherical, the term thus refers to particles in which the vast majority of particles are spherical. Thus, in the context of the present invention, no less than 50%, 55%, 60%, 65%, 70%, 75%, 80%, 85%, 90% or 95% of the particles are spherical.

The present invention relates to a washing or cleaning agent, in particular a multiphase washing or cleaning agent, as defined above. At least one of the phases is a liquid, low-water to water-free phase. Furthermore, at least one further phase is a solid, powder or granular phase. According to the present invention, said at least one solid phase is distinguished in that it contains at least one bleach activator, the bleach activator being compounded with at least one complexing agent.

In this context, "compounded" means that the individual particles of the bleach activator are coated/wrapped in the at least one complexing agent. The coating or wrapping need not be complete with respect to the particle surface but, in preferred embodiments, the entire surface of the bleach activator particle is coated/wrapped in the complexing agent. Suitable methods for compounding substances are known in the prior art. Methods of this kind include, but are not limited to, fluidized bed granulation methods. In various embodiments, the bleach activator is initially provided in particulate form and then granulated ("compounded") using a solution of the complexing agent, preferably an aqueous solution. In various embodiments, a spray-coating method is used for this purpose. In this method, the bleach activator particles, which may be of different shapes and sizes, are agitated in a fluidized bed and, in the process, sprayed with a liquid (complexing agent solution or suspension). The aqueous or organic solvent evaporates, and the complexing agent contained therein forms the coating layer. Typical particle sizes are from 100 micrometers to 3 millimeters. Spray coating of this kind can be carried out in all fluidized bed systems, typically in batch operation. For some coating applications, continuous processes are also available. In this case, it is important to ensure that no liquid bridges are formed during application in order to avoid undesirable agglomeration. Depending on the direction in which the particle is sprayed, the coating can be carried out in a top spray, tangential spray, bottom spray method (Wurster process) or in a rotor method. The mentioned methods can be carried out in a single modern fluidized bed system. Alternatively, the compounding can also be carried out as spray agglomeration. In this case, the bleach activator particles, which are usually very small powder particles, are agitated in the fluidized bed and sprayed with a binder liquid containing the complexing agent. By forming liquid bridges, the particles combine to form agglomerates. The spraying process is continued until the agglomerates are of the desired size. Typical sizes of the agglomerates range from 100 micrometers to 3 millimeters, whereas the starting materials may be in microfine form. Suitable fluidized bed systems for the mentioned methods are available, for example, from Glatt GmbH (Binzen, Del.). Suitable methods are described, for example, in the German patent application DE 10 2007 051 093 A1.

By compounding the bleach activator with a complexing agent, premature activation of the bleaching agent contained in the agents is prevented to a greater degree. In this context, "premature" describes a point in time which comes before the agent is used in a washing or cleaning method, for example a textile washing method or automatic dishwashing method, i.e. when the agent is in storage, for example. Without wishing to be bound by any particular theory, it is assumed that the stabilizing effect of the complexing agent covering of the bleach activator described herein is largely due to the binding of free calcium and iron ions which, upon contact with bleach activator substances, result in activation. When using the agent according to the invention in washing or cleaning methods, the agent comes into contact with water, as a result of which the individual phases of the agent disintegrate. The coating of the bleach activator according to the invention thus dissolves and the bleach-active substances contained in the agent are activated.

In the agents according to the invention, the at least one compounded bleach activator is contained in the washing or cleaning agent in an amount in the range of from 1 wt. % to 20 wt. %, preferably from 1 wt. % to 15 wt. %, in particular from 1 wt. % to 13 wt. %, based in each case on the total weight of the washing or cleaning agent.

In various embodiments, the at least one complexing agent is a complexing agent, preferably an organic complexing agent, which binds $Ca^{2+}$ at 20° C. and pH 10 at a calcium binding capacity mg CaO/g of at least 100, preferably at least 150, more preferably at least 200, even more preferably at least 300, most particularly preferably at least 350.

The calcium binding capacity is determined by means of visual turbidimetric titration using calcium acetate solution and sodium carbonate in the alkaline range and then conversion into calcium binding capacity mg CaO/g.

The following apparatuses are required:

pH meter, magnetic stirrer, 10 ml volumetric pipette, 50 ml burette and 250 ml beakers Chemicals:

Calcium acetate solution (39.6 g/l in distilled water)

Sodium carbonate solution (2%)

c(NaOH)=1 mol/l

Method:

1.00 g of the complexing agent to be tested is weighed out in a 250 ml beaker and dissolved using approx. 100 ml of distilled water. If required, the pH of this solution is first raised to approx. 8-9 using 1M NaOH, and then exactly 10 ml of 2% $Na_2CO_3$ solution is added to the solution. Then, the pH of the resulting solution is set to 11.0 using 1M NaOH, and the total volume of the solution is increased to 150 ml.

The titration is carried out at 20° C. by gradually adding Ca acetate solution, until permanent turbidity is reached, with smaller volume increments being added toward the end of the titration. There is no stirring while the titrant is being added. Stirring occurs between additions and the pH is kept constant using 1M NaOH. 1 ml of calcium acetate solution used corresponds to 25 mg of calcium carbonate.

Calculation of calcium binding strength:

a) calculation of Ca binding strength as $CaCO_3$ $$\text{consumption [ml]} \times c_{(Ca\ acetate\ solution)} \times M_{CaCO3}/\text{weight (g)} = \text{mg } CaCO_3/g$$

or:

$$CaCO_3 \text{ binding strength [mg } CaCO_3/g] = \frac{\text{consumption [ml]} \times 25\left[\frac{mg}{ml}\right]}{\text{weight [g]}}$$

The conversion into calcium binding capacity mg CaO/g is subsequently carried out by multiplying the $CaCO_3$ binding strength [mg $CaCO_3$/g] by 0.560.

For example, at 20° C. and pH 10, HEDP (tetrasodium salt) has a value of approximately 400 mg CaO/g and DTPMP (heptasodium salt) has a value of approximately 700 mg CaO/g.

In various embodiments, the at least one complexing agent is selected from phosphonates, aminocarboxylic acid salts and (polymeric) polycarboxylates and their corresponding acids.

According to the invention, phosphonates are not subsumed under phosphates. Aminoalklane and/or hydroxyalkane phosphonates are preferably used as phosphonates. Possible preferable aminoalkane phosphonates include diethylenetriamine pentamethylene phosphonate (DTPMP), nitrilotris(methylenephosphonic acid) (NTMP), 2-phosphonobutane-1,2,4-tricarboxylic acid (PBTC), ethylenediamine tetramethylene phosphonate (EDTMP), and the higher homologs thereof. Among the hydroxyalkane phosphonates, 1-hydroxyethane-1,1-diphosphonate (HEDP) is of particular importance.

Polycarboxylates are the salts, in particular the alkali salts, more preferably the sodium salts, of polycarboxylic acids, with polycarboxylic acids being understood to be those carboxylic acids that have more than one, in particular two to eight, acid functions, preferably two to six, in particular two, three, four, or five, acid functions in the entire molecule. Dicarboxylic acids, tricarboxylic acids, tetracarboxylic acids, and pentacarboxylic acids, in particular di, tri, and tetracarboxylic acids, are thus preferred as polycarboxylic acids. The polycarboxylic acids can also have further functional groups such as hydroxyl groups. Examples of these include citric acid, adipic acid, succinic acid, glutaric acid, malic acid, tartaric acid, maleic acid, fumaric acid, saccharic acids (preferably aldaric acids, for example galactaric acid and glucaric acid), and mixtures thereof. Preferred salts are the salts of polycarboxylic acids such as citric acid, adipic acid, succinic acid, glutaric acid, tartaric acid, and mixtures thereof.

Polymeric polycarboxylates include, for example, poly (acrylic acid), poly(alpha-hydroxyacrylic acid), poly(acrylic acid-co-maleic acid), poly(tetramethylene-1,2-dicarboxyc acid), poly(4-methoxytetramethylene-1,2-dicarboxylic acid) and poly(acrylic acid-co-allyl alcohol).

Aminocarboxylic acid salts are the salts, in particular the alkali salts, more preferably the sodium salts, of aminocarboxylic acids. Particularly preferred representatives of this class are methyl glycine diacetic acid (MGDA), glutamic acid diacetate (GLDA), aspartic acid diacetate (ASDA), hydroxyethyliminodiacetate (HEIDA), iminodisuccinate (IDS), and ethylenediamine disuccinate (EDDS), particularly preferably MGDA or GLDA.

Compounds which, under perhydrolysis conditions, result in aliphatic peroxocarboxylic acids having preferably 1 to 10 carbon atoms, in particular 2 to 4 carbon atoms, and/or optionally substituted perbenzoic acid, can be used as bleach activators. Substances that have 0 acyl and/or N acyl groups of the stated number of C atoms and/or optionally substituted benzoyl groups are suitable. Preferred are polyacylated alkylene diamines, in particular tetraacetylethylenediamine (TAED), acylated triazine derivatives, in particular 1,5-diacetyl-2,4-dioxo-hexahydro-1,3,5-triazine (DADHT), acylated glycolurils, in particular tetraacetylglycoluril (TAGU), N-acylimides, in particular N-nonanoyl succinimide (NOSI), acylated phenolsulfonates, in particular n-nonanoyl or isononanoyl oxybenzenesulfonate (n- or iso-NOBS), carboxylic acid anhydrides, in particular phthalic acid anhydride, acylated polyhydric alcohols, in particular triacetin, ethylene glycol diacetate, 2,5-diacetoxy-2,5-dihydrofuran and enol esters, and acetylated sorbitol and mannitol or mixtures thereof (SORMAN), acylated sugar derivatives, in particular pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoylcaprolactam. Hydrophilically substituted acyl acetals and acyl lactams are also preferably used. Combinations of conventional bleach activators can also be used. According to the invention, TAED is preferably used as the bleach activator. In various embodiments, TAED is preferably used in particular in combination with a percarbonate bleaching agent, preferably sodium percarbonate.

In various embodiments, the at least one bleach activator is therefore selected from the group consisting of polyacylated alkylenediamines, acylated triazine derivatives, acylated glycolurils, N-acylimides, and acylated phenolsulfonates.

In various embodiments, the at least one complexing agent is selected from the group consisting of DTPMP, HEDP, MGDA or GLDA, very particularly preferably from DTPMP and HEDP, with the at least one complexing agent most preferably being DTPMP.

In various embodiments, the at least one complexing agent is selected from the group consisting of the sodium salt of DTPMP, HEDP, MGDA or GLDA, very particularly preferably consisting of the sodium salt of DTPMP or HEDP, with the at least one complexing agent most preferably being a sodium salt of DTPMP.

In various embodiments, the at least one bleach activator is TAED.

In various embodiments, the complexing agent is selected from the group consisting of DTPMP, HEDP, MGDA or GLDA, very particularly preferably from DTPMP and HEDP, with the complexing agent most preferably being DTPMP.

In various embodiments, the coating amount of the at least one complexing agent on the at least one bleach activator is in the range of from 5 wt. % to 30 wt. %, preferably from 5 to 25 wt. %, in particular from 5 to 20 wt. %, based on the total weight of the compounded bleach activator. In such embodiments, the remainder of the compounded bleach activator consists substantially of the at least one bleach activator. In various embodiments, the amount of the at least one bleach activator in the compounded bleach activator is therefore from 70 to 95 wt. %, preferably from 75 to 95 wt. %, more preferably from 80 to 95 wt. %, based in each case on the total weight of the particle.

The washing or cleaning agent according to the invention preferably contains at least one bleaching agent. According to the invention, a "bleaching agent" should be understood to mean hydrogen peroxide itself and any compound which yields hydrogen peroxide in an aqueous medium. From the compounds which act as bleaching agents and yield $H_2O_2$ in water, sodium percarbonate, sodium perborate tetrahydrate and sodium perborate monohydrate are of particular importance. Some other examples of bleaching agents that can be used are peroxypyrophosphates, citrate perhydrates, and $H_2O_2$-yielding peracidic salts or peracids, such as persulfates or persulfur acid. Urea peroxohydrate percarbamide, which can be described by the formula $H_2N—CO—NH_2$ $H_2O_2$, can also be used. In particular, when using the agent for cleaning hard surfaces, for example during automatic dishwashing, if desired, the agents according to the invention may also contain bleaching agents from the group of organic bleaching agents; however, the use thereof is in principle also possible in agents for textile washing. Typical organic bleaching agents are diacyl peroxides, such as dibenzoyl peroxide. Other typical organic bleaching agents are peroxy acids, with particular mention of alkylperoxy acids and arylperoxy acids as examples. Preferred representatives are (a) peroxybenzoic acid and the ring-substituted derivatives thereof such as alkyl peroxy benzoic acids, but also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid (phthalimidoperoxyhexanoic acid, PAP), o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, and N,N-terephthaloyl-di(6-aminopercaproic acid).

Chlorine or bromine-releasing substances can also be used as bleaching agents, but these are not preferred according to the invention. Examples of suitable chlorine or bromine-releasing materials are heterocyclic N-bromo and N-chloroamides, for example trichloroisocyanuric acid, tribromoisocyanuric acid, dibromoisocyanuric acid and/or dichloroisocyanuric acid (DICA) and/or the salts thereof with cations such as potassium and sodium. Hydantoin compounds such as 1,3-dichloro-5,5-dimethylhydantoin are also suitable.

In various embodiments, the washing or cleaning agents can contain from 1 to 35 wt. %, preferably from 2.5 to 30 wt. %, particularly preferably from 3.5 to 20 wt. %, and in particular from 5 to 15 wt. %, of bleaching agents, preferably sodium percarbonate, based in each case on the total weight of the washing or cleaning agent. Based on the total weight of the solid phase, the amount of bleaching agent in the solid phase, preferably sodium percarbonate, may be from 5 to 50 wt. %, preferably from 10 to 40 wt. %.

In various embodiments, the washing or cleaning agent according to the invention also contains one or more substances selected from the group consisting of further complexing agents, further bleach activators, bleach catalysts, anionic, non-ionic, cationic and amphoteric surfactants, builders, enzymes, enzyme stabilizers, builders, electrolytes, non-aqueous solvents, pH adjusters, odor absorbers, deodorizing substances, perfumes, perfume carriers, fluorescing agents, dyes, hydrotropic substances, foam inhibitors, silicone oils, anti-redeposition agents, graying inhibitors, anti-shrink agents, anti-crease agents, dye transfer inhibitors, antimicrobial active ingredients, germicides, fungicides, antioxidants, preservatives, corrosion inhibitors, antistatic agents, bittering agents, ironing aids, repellents and impregnating agents, anti-swelling and anti-slip agents, softening components and UV absorbers.

In various embodiments, the washing or cleaning agent according to the invention contains at least one bleach catalyst. Bleach catalysts include, inter alia, sulfone imines and/or bleach-enhancing transition metal salts or transition metal complexes. The transition metal compounds include in particular manganese, iron, cobalt, ruthenium or molybdenum salene complexes and the N-analogues thereof, manganese, iron, cobalt, ruthenium or molybdenum carbonyl complexes, manganese, iron, cobalt, ruthenium, molybdenum, titanium, vanadium and copper complexes comprising nitrogen-containing tripod ligands, cobalt, iron, copper and ruthenium amine complexes. Bleach-enhancing transition metal complexes, in particular having the central atoms Mn, Fe, Co, Cu, Mo, V, Ti and/or Ru, can be used in usual amounts, preferably in an amount of up to 1 wt. %, in particular from 0.0025 to 0.25 wt. %, and particularly preferably from 0.01 to 0.1 wt. %, based in each case on the total weight of the washing or cleaning agent. In special cases, however, more bleach catalysts can be used.

Complexes of manganese in oxidation stage II, III, IV, or IV are particularly preferably used which preferably contain one or more macrocyclic ligands having the donor functions N, NR, PR, O and/or S. Preferably, ligands are used which have nitrogen donor functions. It is particularly preferable to use bleach catalyst(s) in the agents according to the invention which contain(s), as a macromolecular ligand, 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (Me/Me-TACN), and/or 2-methyl-1,4,7-triazacyclononane (Me/TACN). Suitable manganese complexes are for example $[Mn^{III}{}_2(\mu\text{-}O)_1(\mu\text{-}OAc)_2(TACN)_2](ClO_4)_2$, $[Mn^{III}Mn^{IV}(\mu\text{-}O)_2(\mu\text{-}OAc)_1(TACN)_2](BPh_4)_2$, $[Mn^{IV}{}_4(\mu\text{-}O)_6(TACN)_4](ClO_4)_4$, $[Mn^{III}{}_2(\mu\text{-}O)_1(\mu\text{-}OAc)_2(Me\text{-}TACN)_2](ClO_4)_2$, $[Mn^{III}Mn^{IV}(\mu\text{-}O)_1(\mu\text{-}OAc)_2(Me\text{-}TACN)_2](ClO_4)_3$, $[Mn^{IV}{}_2(\mu\text{-}O)_3(Me\text{-}TACN)_2](PF_6)_2$ and $[Mn^{IV}{}_2(\mu\text{-}O)_3(Me/Me\text{-}TACN)_2](PF_6)_2$ ($OAc{=}OC(O)CH_3$).

Washing or cleaning agents which contain at least one bleach catalyst are preferred according to the invention, with the bleach catalyst being selected from the group of bleach-enhancing transition metal salts and transition metal complexes, preferably the complexes of manganese in oxidation stage II, III, IV or IV containing one or more macrocyclic ligand(s) having the donor functions N, NR, PR, O and/or S, particularly preferably the macromolecular ligands 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (Me/Me-TACN) and/or 2-methyl-1,4,7-triazacyclononane (Me/TACN), most preferably the ligands 1,4,7-trimethyl-1,4,7-triazacyclononane (Me-TACN) or 1,2,4,7-tetramethyl-1,4,7-triazacyclononane (Me/Me-TACN).

The use of the above-mentioned Mn-based metal complexes in automatic dishwashing detergents is preferred according to the invention, since in particular the cleaning result can be significantly improved by the above-mentioned bleach catalysts.

In various embodiments, the washing or cleaning agent according to the invention contains at least one surfactant, selected from the group of anionic surfactants, non-ionic surfactants, cationic surfactants, amphoteric surfactants, and mixtures thereof.

Suitable anionic surfactants are those of formula (I)

$$R{-}SO_3^-Y^+ \qquad \text{(I).}$$

In formula (I), R represents a linear or branched unsubstituted alkyl aryl functional group. Y represents a monovalent cation or the n-th part of an n-valent cation, in this case the alkali metal ions, including $Na^+$ or K+, being preferred, $Na^+$ being most preferred. Other cations $Y^+$ may be selected from $NH_4^+$, $\frac{1}{2}Zn^{2+}$, $\frac{1}{2}Mg^{2+}$, $\frac{1}{2}Ca^{2+}$, $\frac{1}{2}Mn^+$ and mixtures thereof.

"Alkyl aryl," as used herein, refers to organic functional groups which consist of an alkyl functional group and an aromatic functional group. Typical examples of functional groups of this kind include, but are not limited to, alkylbenzene functional groups, such as benzyl, butylbenzene functional groups, nonylbenzene functional groups, decylbenzene functional groups, undecylbenzene functional groups, dodecylbenzene functional groups, tridecylbenzene functional groups, and the like.

In various embodiments, surfactants of this kind are selected from linear or branched alkylbenzene sulfonates of formula A-1

(A-1)

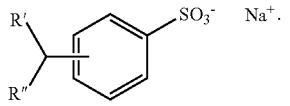

in which R' and R" together contain 9 to 19, preferably 11 to 15 and in particular 11 to 13, C atoms. A very particularly preferred representative can be described by formula A-1a:

(A-1a)

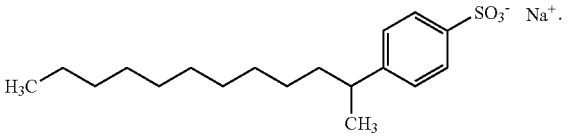

In various embodiments, the compound of formula (I) is preferably the sodium salt of a linear alkylbenzene sulfonate.

Other suitable anionic surfactants are those of formula (II)

$$R^1{-}O\text{-}(AO)_n{-}SO_3^-X^+ \qquad \text{(II).}$$

In formula (II), $R^1$ represents a linear or branched, substituted or unsubstituted alkyl, aryl or alkyl aryl functional group, preferably a linear, unsubstituted alkyl functional group, particularly preferably a fatty alcohol functional group. Preferred functional groups $R^1$ are selected from decyl, undecyl, dodecyl, tridecyl, tetradecyl, pentadecyl, hexadecyl, heptadecyl, octadecyl, nonadecyl, eicosyl functional groups and mixtures thereof, the representatives having an even number of C atoms being preferred. Particularly preferred functional groups $R^1$ are derived from $C_{12}$-$C_{18}$ fatty alcohols, for example from coconut fatty alcohol, tallow fatty alcohol, lauryl, myristyl, cetyl or stearyl alcohol, or from $C_{10}$-$C_{20}$ oxo alcohols.

AO represents an ethylene oxide (EO) or propylene oxide (PO) group, preferably an ethylene oxide group. The index n represents an integer from 1 to 50, preferably from 1 to 20, and in particular from 2 to 10. Very particularly preferably, n represents the numbers 2, 3, 4, 5, 6, 7 or 8. X represents a monovalent cation or the n-th part of an n-valent cation, in this case the alkali metal ions, including $Na^+$ or $K^+$, being preferred, $Na^+$ being most preferred. Other cations $X^+$ may be selected from $NH_4^+$, $\frac{1}{2}Zn^{2+}$, $\frac{1}{2}Mg^{2+}$, $\frac{1}{2}Ca^{2+}$, $\frac{1}{2}Mn^{2+}$ and mixtures thereof.

Fatty alcohol ether sulfates of formula A-2 are preferred (A-2)

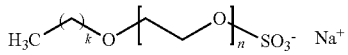

where k=11 to 19, and n=2, 3, 4, 5, 6, 7 or 8. Particularly preferred representatives are Na—$C_{12\text{-}14}$ fatty alcohol ether sulfates having 2 EO (k=11-13, n=2 in formula A-2).

Other anionic surfactants that can be used are the alkyl sulfates of formula $$R^2{-}O{-}SO_3^-X^+ \qquad \text{(III).}$$

In formula (III), $R^2$ represents a linear or branched, substituted or unsubstituted alkyl functional group, preferably a linear, unsubstituted alkyl functional group, particularly preferably a fatty alcohol functional group. Preferred functional groups $R^2$ are selected from decyl, undecyl, dodecyl, tridecyl, tetradecyl, pentadecyl, hexadecyl, heptadecyl, octadecyl, nonadecyl, eicosyl functional groups and mixtures thereof, the representatives having an even number of C atoms being preferred. Particularly preferred functional groups $R^2$ are derived from $C_{12}$-$C_{18}$ fatty alcohols, for example from coconut fatty alcohol, tallow fatty alcohol, lauryl, myristyl, cetyl or stearyl alcohol, or from $C_{10}$-$C_{20}$ oxo alcohols. X represents a monovalent cation or the n-th part of an n-valent cation, in this case the alkali metal ions, including $Na^+$ or $K^+$, being preferred, $Na^+$ being most preferred. Other cations $X^+$ may be selected from $NH_4^+$, $\frac{1}{2}Zn^{2+}$, $\frac{1}{2}Mg^{2+}$, $\frac{1}{2}Ca^{2+}$, $\frac{1}{2}Mn^{2+}$ and mixtures thereof.

In various embodiments, these surfactants are selected from fatty alcohol sulfates of formula A-3

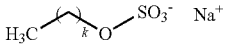

(A-3)

where k=11 to 19. Very particularly preferred representatives are Na—$C_{12-14}$ fatty alcohol sulfates (k=11-13 in formula A-3).

In the agents according to the invention, the anionic surfactant content is preferably less than 4 wt. %, particularly preferably less than 2 wt. %, and in particular less than 1 wt. %. Dishwashing detergents which do not contain anionic surfactants are particularly preferred.

Low-foaming non-ionic surfactants are preferably used, in particular alkoxylated, more particularly ethoxylated, low-foaming non-ionic surfactants. Particularly preferably, the automatic dishwashing detergents contain non-ionic surfactants from the group of alkoxylated alcohols.

m represents an integer from 1 to 50, preferably from 1 to 20, and in particular from 2 to 10. Very particularly preferably, m represents the numbers 2, 3, 4, 5, 6, 7 or 8.

In summary, fatty alcohol alkoxylates that can preferably be used are compounds of formula

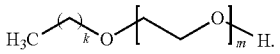

(V)

where k=11 to 19, m=2, 3, 4, 5, 6, 7 or 8. Very particularly preferred representatives are $C_{12-18}$ fatty alcohols having 7 EO (k=11-17, m=7 in formula (V)).

One class of non-ionic surfactants that can be used, which can be used either as the sole non-ionic surfactant or in combination with other non-ionic surfactants, is therefore alkoxylated, preferably ethoxylated or ethoxylated and propoxylated fatty acid alkyl esters, preferably having 1 to 4 carbon atoms in the alkyl chain.

Surfactants that can preferably be used originate from the group of ethoxylated primary alcohols and mixtures of these surfactants with structurally complicated surfactants such as polyoxypropylene/polyoxyethylene/polyoxypropylene ((PO/EO/PO) surfactants). (PO/EO/PO) non-ionic surfactants of this kind are distinguished by good foam control.

Particularly preferred non-ionic surfactants are those that have alternating ethylene oxide and alkylene oxide units. Among these, in turn, surfactants having EO-AO-EO-AO blocks are preferred, with one to ten EO groups or AO groups being bonded to one another before a block of the other group follows. Here, non-ionic surfactants of the below general formula are preferred $$R^1—O—(CH_2—CH_2—O)_w—(CH_2—\underset{\underset{R^2}{|}}{CH}—O)_x—(CH_2—CH_2—O)_y—(CH_2—\underset{\underset{R^3}{|}}{CH}—O)_z—H$$

Suitable non-ionic surfactants are in particular fatty alcohol alkoxylates. In various embodiments, the washing agents therefore contain at least one non-ionic surfactant of formula $$R^3—O\text{-}(AO)_m—H \qquad \text{(IV)},$$

in which $R^3$ represents a linear or branched, substituted or unsubstituted alkyl functional group, AO represents an ethylene oxide (EO) or propylene oxide (PO) group, m represents integers from 1 to 50.

In the aforementioned formula (IV), $R^3$ represents a linear or branched, substituted or unsubstituted alkyl functional group, preferably a linear, unsubstituted alkyl functional group, particularly preferably a fatty alcohol functional group. Preferred functional groups $R^2$ are selected from decyl, undecyl, dodecyl, tridecyl, tetradecyl, pentadecyl, hexadecyl, heptadecyl, octadecyl, nonadecyl, eicosyl functional groups and mixtures thereof, the representatives having an even number of C atoms being preferred. Particularly preferred functional groups $R^3$ are derived from $C_{12}$-$C_{18}$ fatty alcohols, for example from coconut fatty alcohol, tallow fatty alcohol, lauryl, myristyl, cetyl or stearyl alcohol, or from $C_{10}$-$C_{20}$ oxo alcohols.

AO represents an ethylene oxide (EO) or propylene oxide (PO) group, preferably an ethylene oxide group. The index in which $R^1$ represents a straight-chain or branched, saturated or mono or polyunsaturated $C_{6-24}$ alkyl or alkenyl functional group, each $R^2$ and $R^3$ group being selected, independently of one another, from $—CH_3$, $—CH_2CH_3$, $—CH_2CH_2—CH_3$, $CH(CH_3)_2$, and the indices w, x, y and z representing, independently of one another, integers from 1 to 6.

Thus, particularly preferred are non-ionic surfactants having a $C_{9-15}$ alkyl functional group having 1 to 4 ethylene oxide units followed by 1 to 4 propylene oxide units followed by 1 to 4 ethylene oxide units followed by 1 to 4 propylene oxide units.

Preferred non-ionic surfactants are those of the general formula $$R^1—\underset{\underset{R^2,}{|}}{CH}(OH)CH_2O\text{-}(AO)_w\text{-}(A'O)_x\text{-}(A''O)_y\text{-}(A'''O)_z—$$

in which $R^1$ represents a straight-chain or branched, saturated or mono or polyunsaturated $C_{6-24}$ alkyl or alkenyl functional group;

$R^2$ represents H or a linear or branched hydrocarbon functional group having 2 to 26 carbon atoms;

A, A', A" and A"' represent, independently of one another, a functional group from the group $—CH_2CH_2$, $—CH_2CH_2—CH_2$, $—CH_2—CH(CH_3)$, $—CH_2—CH_2—CH_2—CH_2$, $—CH_2—CH(CH_3)—CH_2—$, $—CH_2—CH(CH_2—CH_3)$;

w, x, y and z represent values between 0.5 and 120, where x, y and/or z can also be 0.

Particularly preferred are end-capped poly(oxyalkylated) non-ionic surfactants which, according to the formula $R^1O[CH_2CH_2O]_xCH_2CH(OH)R^2$, also comprise, in addition to a functional group $R^1$, which represents linear or branched, saturated or unsaturated, aliphatic or aromatic hydrocarbon functional groups having 2 to 30 carbon atoms, preferably having 4 to 22 carbon atoms, a linear or branched, saturated or unsaturated, aliphatic or aromatic hydrocarbon functional group $R^2$ having 1 to 30 carbon atoms, in which x represents values between 1 and 90, preferably values between 30 and 80, and in particular values between 30 and 60.

Particularly preferred are surfactants of the formula $R^1O[CH_2CH(CH_3)O]_x[CH_2CH_2O]_yCH_2CH(OH)R^2$, in which $R^1$ represents a linear or branched aliphatic hydrocarbon functional group having 4 to 18 carbon atoms or mixtures thereof, $R^2$ represents a linear or branched hydrocarbon functional group having 2 to 26 carbon atoms or mixtures thereof, x represents values between 0.5 and 1.5, and y represents a value of at least 15.

The group of these non-ionic surfactants includes, for example, $C_{2-26}$ fatty alcohol-$(PO)_1$-$(EO)_{15-40}$-2-hydroxyalkyl ethers, in particular also $C_{8-10}$ fatty alcohol-$(PO)_1$-$(EO)_{22}$-2-hydroxydecyl ethers.

Particularly preferred are also end-capped poly(oxyalkylated) non-ionic surfactants of the formula $R^1O[CH_2CH_2O]_x[CH_2CH(R^3)O]_yCH_2CH(OH)R^2$, in which $R^1$ and $R^2$ represent, independently of one another, a linear or branched, saturated or mono or polyunsaturated hydrocarbon functional group having 2 to 26 carbon atoms, $R^3$ is selected, independently of one another, from $—CH_3$, $—CH_2CH_3$, $—CH_2CH_2—CH_3$, $—CH(CH_3)_2$, but preferably represents $—CH_3$, and x and y represent, independently of one another, values between 1 and 32, non-ionic surfactants having $R^3$=$—CH_3$ and values for x of from 15 to 32 and for y of 0.5 and 1.5 being very particularly preferred.

Further non-ionic surfactants that can preferably be used are the end-capped poly(oxyalkylated) non-ionic surfactants of the formula $R^1O[CH_2CH(R^3)O]_x[CH_2]_kCH(OH)[CH_2]_jOR^2$, in which $R^1$ and $R^2$ represent linear or branched, saturated or unsaturated, aliphatic or aromatic hydrocarbon functional groups having 1 to 30 carbon atoms, $R^3$ represents H or a methyl, ethyl, n-propyl, iso-propyl, n-butyl, 2-butyl or 2-methyl-2-butyl functional group, x represents values between 1 and 30, and k and j represent values between 1 and 12, preferably between 1 and 5. If the value is $x \geq 2$, every $R^3$ in the above formula $R^1O[CH_2CH(R^3)O]_x[CH_2]_kCH(OH)[CH_2]_jOR^2$ can be different. $R^1$ and $R^2$ are preferably linear or branched, saturated or unsaturated, aliphatic or aromatic hydrocarbon functional groups having 6 to 22 carbon atoms, with functional groups having 8 to 18 C atoms being particularly preferred. H, $—CH_3$ or $—CH_2CH_3$ are particularly preferred for functional group $R^3$. Particularly preferred values for x are in the range of from 1 to 20, in particular from 6 to 15.

As described above, every $R^3$ in the above formula can be different if $x \geq 2$. In this way, the alkylene oxide unit in square brackets can be varied. For example, if x represents 3, functional group $R^3$ can be selected in order to form ethylene oxide ($R^3$=H) or propylene oxide ($R^3$=$CH_3$) units, which can be joined together in any sequence, for example (EO)(PO)(EO), (EO)(EO)(PO), (EO)(EO)(EO), (PO)(EO)(PO), (PO)(PO)(EO), and (PO)(PO)(PO). The value 3 for x has been selected here for the sake of example and can by all means be greater, in which case the range of variation increases as the values for x increase and includes a large number of (EO) groups together with a small number of (PO) groups, for example, or vice versa.

Particularly preferred end-capped poly(oxyalkylated) alcohols of the above formula have values of k=1 and j=1, so that the previous formula is simplified to $R^1O[CH_2CH(R^3)O]_xCH_2CH(OH)CH_2OR^2$. In the formula mentioned last, $R^1$, $R^2$ and $R^3$ are as defined above and x represents numbers from 1 to 30, preferably from 1 to 20, and in particular from 6 to 18. Surfactants are particularly preferred in which functional groups $R^1$ and $R^2$ have 9 to 14 C atoms, $R^3$ represents H, and x assumes values of from 6 to 15.

Finally, the non-ionic surfactants of the general formula $R^1—CH(OH)CH_2O-(AO)_w—R^2$ have been found to be particularly effective, in which

- $R^1$ represents a straight-chain or branched, saturated or mono or polyunsaturated $C_{6-24}$ alkyl or alkenyl functional group;
- $R^2$ represents a linear or branched hydrocarbon group having 2 to 26 carbon atoms;
- A represents a functional group from the group $CH_2CH_2$, $CH_2CH_2CH_2$, $CH_2CH(CH_3)$, preferably $CH_2CH_2$, and
- w represents values between 1 and 120, preferably 10 to 80, in particular 20 to 40.

The group of these non-ionic surfactants includes, for example, $C_{4-22}$ fatty alcohol-$(EO)_{10-80}$-2-hydroxyalkyl ethers, in particular also $C_{8-12}$ fatty alcohol-$(EO)_{22}$-2-hydroxydecyl ethers and $C_{4-22}$ fatty alcohol-$(EO)_{40-80}$-2-hydroxyalkyl ethers.

In various embodiments of the invention, instead of the above-defined end-capped hydroxy mixed ethers, it is also possible to use the corresponding non-end-capped hydroxy mixed ethers. These may satisfy the above formulas, but $R^2$ is hydrogen and $R^3$, A, A', A", A"', w, x, y and z are as defined above.

The agents described herein, which preferably comprise at least one non-ionic surfactant, particularly preferably a non-ionic surfactant from the group of hydroxy mixed ethers, contain the further non-ionic surfactant, in various embodiments, in an amount of at least 1 wt. %, preferably at least 2.5 wt. %, based on the total weight of the agent.

Other non-ionic surfactants that can be contained in the described agents within the meaning of the present invention include, but are not limited to, alkyl glycosides, alkoxylated fatty acid alkyl esters, amine oxides, fatty acid alkanolamides, hydroxy mixed ethers, sorbitan fatty acid esters, polyhydroxy fatty acid amides and alkoxylated alcohols.

Suitable non-ionic surfactants include, for example, alkyl glycosides of the general formula $RO(G)_x$, in which R corresponds to a primary straight-chain or methyl-branched aliphatic functional group, in particular an aliphatic functional group that is methyl-branched in position 2, having 8 to 22, preferably 12 to 18 C atoms, and G is the symbol that represents a glycose unit having 5 or 6 C atoms, preferably glucose. The degree of oligomerization x, which indicates the distribution of monoglycosides and oligoglycosides, is any number between 1 and 10; x is preferably 1.2 to 1.4.

Non-ionic surfactants of the amine oxide type, for example N-cocoalkyl-N,N-dimethylamine oxide and N-tallow alkyl-N,N-dihydroxyethylamine oxide, and of the fatty acid alkanolamide type can also be suitable. The amount of these non-ionic surfactants is preferably no more than that of the ethoxylated fatty alcohols, in particular no more than half thereof.

Other suitable surfactants are the polyhydroxy fatty acid amides that are known as PHFAs.

Soaps can be used as further optional surfactant ingredients, saturated fatty acid soaps being suitable, such as the salts of lauric acid, myristic acid, palmitic acid or stearic acid, and soaps derived from natural fatty acid mixtures, such as coconut fatty acids, palm kernel fatty acids or tallow fatty acids. In particular, soap mixtures are preferred which are composed of from 50 wt. % to 100 wt. % of saturated $C_{12}$-$C_{18}$ fatty acid soaps and up to 50 wt. % of oleic acid soap. Soap is preferably contained in amounts of from 0.1 wt. % to 5 wt. %. In particular, however, higher amounts of soap of generally up to 20 wt. % may also be contained in the liquid phase.

Suitable amphoteric surfactants are, for example, betaines of formula $(R^{iii})(R^{iv})(R^{v})N^{+}CH_2COO^{-}$, in which $R^{iii}$ represents an alkyl functional group, which is optionally interrupted by heteroatoms or heteroatom groups, having 8 to 25, preferably 10 to 21, carbon atoms, and $R^{iv}$ and $R^{v}$ represent identical or different alkyl functional groups having 1 to 3 carbon atoms, in particular $C_{10}$-$C_{18}$ alkyl dimethyl carboxymethyl betaine and $C_{11}$-$C_{17}$ alkyl amidopropyl dimethyl carboxymethyl betaine.

Suitable cationic surfactants are, inter alia, the quaternary ammonium compounds of formula $(R^{vi})(R^{vii})(R^{viii})(R^{ix})N^{+}X^{-}$, in which $R^{vi}$ to $R^{ix}$ represent four identical or different, and in particular two long-chain and two short-chain, alkyl functional groups, and $X^{-}$ represents an anion, in particular a halide ion, for example didecyl dimethyl ammonium chloride, alkyl benzyl didecyl ammonium chloride and mixtures thereof. Other suitable cationic surfactants are quaternary surface-active compounds, in particular comprising a sulfonium, phosphonium, iodonium or arsonium group, which are also known as antimicrobial active ingredients. By using quaternary surface-active compounds having an antimicrobial effect, the agent can be formed having an antimicrobial effect, or the antimicrobial effect thereof that may already be present owing to other ingredients can be improved.

In various embodiments, the at least one surfactant is preferably contained in the at least one liquid phase of the washing and cleaning agent according to the invention.

In various embodiments, the total amount of surfactants is from 1 to 45 wt. %, preferably from 5 to 25 wt. %, based on the weight of the agent.

In a further embodiment, the agent according to the invention contains water-soluble and/or water-insoluble builders, in particular selected from alkali aluminosilicate, crystalline alkali silicate having a modulus above 1, monomeric polycarboxylate, polymeric polycarboxylate and mixtures thereof, in particular in amounts in the range of from 2.5 wt. % to 60 wt. %. Further builders which may be contained in the dishwashing detergent in the amounts mentioned are, in particular, the complexing agents mentioned in connection with the compounding of the bleach activator, and also carbonates and mixtures of these substances.

The water-soluble organic builder substances include in particular those of the class of polycarboxylic acids, in particular citric acid and saccharic acids, and polymeric (poly)carboxylic acids, in particular polycarboxylates that can be obtained by oxidation of polysaccharides, polymeric acrylic acids, methacrylic acids, maleic acids, and mixed polymers thereof, which may also contain, in the polymer, small portions of polymerizable substances, without a carboxylic acid functionality. The relative molecular mass of the homopolymers of unsaturated carboxylic acids is generally between 5,000 g/mol and 200,000 g/mol, and the relative molecular mass of the copolymers is generally between 2,000 g/mol and 200,000 g/mol, preferably between 50,000 g/mol and 120,000 g/mol, based on the free acid. A particularly preferred acrylic acid-maleic acid copolymer has a relative molecular mass of from 50,000 g/mol to 100,000 g/mol. Compounds of this class which are suitable, although less preferred, are copolymers of acrylic acid or methacrylic acid with vinyl ethers, such as vinyl methyl ethers, vinyl esters, ethylene, propylene, and styrene, in which the proportion of the acid is at least 50 wt. %. Terpolymers which contain, as monomers, two carboxylic acids and/or salts thereof and, as the third monomer, vinyl alcohol and/or a vinyl alcohol derivative or a carbohydrate can also be used as water-soluble organic builder substances. The first acidic monomer or the salt thereof is derived from a monoethylenically unsaturated $C_3$-$C_8$ carboxylic acid and preferably from a $C_3$-$C_4$ monocarboxylic acid, in particular from (meth)acrylic acid. The second acidic monomer or the salt thereof can be a derivative of a $C_4$-$C_8$ dicarboxylic acid, maleic acid being particularly preferred. The third monomeric unit is formed in this case of vinyl alcohol and/or preferably an esterified vinyl alcohol. In particular, vinyl alcohol derivatives are preferred which constitute an ester of short-chain carboxylic acids, for example of $C_1$-$C_4$ carboxylic acids, with vinyl alcohol. Preferred terpolymers contain from 60 wt. % to 95 wt. %, in particular from 70 wt. % to 90 wt. %, of (meth)acrylic acid and/or (meth)acrylate, particularly preferably acrylic acid and/or acrylate, and maleic acid and/or maleate, and from 5 wt. % to 40 wt. %, preferably from 10 wt. % to 30 wt. %, of vinyl alcohol and/or vinyl acetate. Very particularly preferred are terpolymers in which the weight ratio of (meth)acrylic acid and/or (meth)acrylate to maleic acid and/or maleate is between 1:1 and 4:1, preferably between 2:1 and 3:1 and in particular between 2:1 and 2.5:1. The amounts and the weight ratios refer to the acids. The second acidic monomer or the salt thereof may also be a derivative of an allyl sulfonic acid which is substituted in position 2 with an alkyl functional group, preferably with a $C_1$-$C_4$ alkyl functional group, or an aromatic functional group which is preferably derived from benzene or benzene derivatives. Preferred terpolymers contain from 40 wt. % to 60 wt. %, in particular from 45 to 55 wt. %, of (meth)acrylic acid and/or (meth)acrylate, particularly preferably acrylic acid and/or acrylate, from 10 wt. % to 30 wt. %, preferably from 15 wt. % to 25 wt. %, of methallyl sulfonic acid and/or methallyl sulfonate and, as the third monomer, from 15 wt. % to 40 wt. %, preferably from 20 wt. % to 40 wt. %, of a carbohydrate. This carbohydrate may be, for example, a monosaccharide, disaccharide, oligosaccharide or polysaccharide, with monosaccharides, disaccharides or oligosaccharides being preferred, with saccharose being particularly preferred. By inserting the third monomer, break points are presumably incorporated into the polymer which are responsible for the high biodegradability of the polymer. These terpolymers generally have a relative molecular mass of between 1,000 g/mol and 200,000 g/mol, preferably between 2,000 g/mol and 50,000 g/mol, and in particular between 3,000 g/mol and 10,000 g/mol.

The dishwashing detergents can also contain, as further builders, in particular phosphonates which, according to the invention, are not subsumed under phosphates. A hydroxyalkane and/or aminoalkane phosphonate is preferably used as a phosphonate compound. Among the hydroxyalkane phosphonates, 1-hydroxy ethane-1,1-diphosphonate (HEDP) is of particular importance. Possible preferable aminoalkane phosphonates include ethylenediamine tetramethylene phosphonate (EDTMP), diethylenetriamine pentamethylene phosphonate (DTPMP) and the higher homologs thereof. Phosphonates are preferably contained in the agents in amounts of from 0.1 to 10 wt. %, in particular in amounts of from 0.3 to 8 wt. %, based in each case on the total weight of the dishwashing detergent.

The use of citric acid and/or citrates has been found to be particularly advantageous for cleaning and rinsing performance. According to the invention, automatic dishwashing detergents are therefore preferred, characterized in that the dishwashing detergent contains citric acid or a salt of citric acid, and in that the weight proportion of citric acid or the salt of citric acid is preferably from 1 to 40 wt. %, preferably from 10 to 25 wt. %, and in particular between 15 and 22 wt. %.

Aminocarboxylic acids and/or the salts thereof represent a further class of importance of the phosphate-free builders. Particularly preferred representatives of this class are methyl glycine diacetic acid (MGDA) or the salts thereof, and glutamine diacetic acid (GLDA) or the salts thereof, or ethylene diamine diacetic acid (EDDS) or the salts thereof. GLDA or the salts thereof is very particularly preferred. The content of these aminocarboxylic acids or the salts thereof, in particular GLDA sodium salt, can be, for example, between 0.1 and 25 wt. %, preferably between 5 and 25 wt. %, and in particular between 15 and 25 wt. %. Aminocarboxylic acids and the salts thereof can be used, for example, together with the aforementioned builders, in particular together with citrate and the aforementioned phosphonates.

All indicated polycarboxylic acids are generally used in the form of the water-soluble salts thereof, in particular the alkali salts thereof.

Organic builder substances of this kind are preferably contained in amounts of up to 40 wt. %, in particular up to 25 wt. %, and particularly preferably from 1 wt. % to 5 wt. %. Amounts close to the stated upper limit are preferably used in pasty or liquid, in particular water-containing, agents. In other embodiments, amounts close to the stated upper limit are preferably used in solid, powder or granular agents.

In particular crystalline or amorphous alkali aluminosilicates are used as water-insoluble, water-dispersible inorganic builder materials in amounts of up to 50 wt. %, preferably no greater than 40 wt. %, and in liquid agents in particular in amounts of from 1 wt. % to 5 wt. %. Among these, crystalline aluminosilicates of washing agent quality, in particular zeolite NaA and optionally NaX, are preferred. Amounts close to the stated upper limit are preferably used in solid, particulate agents. Suitable aluminosilicates have in particular no particles having a particle size greater than 30 μm and preferably comprise at least 80 wt. % of particles having a size smaller than 10 μm. The calcium binding strength thereof, which can be determined using the information in the German patent specification DE 24 12 837, is in the range of from 100 to 200 mg CaO per gram.

Suitable substitutes or partial substitutes for the stated aluminosilicate are crystalline alkali silicates, which may be present alone or in a mixture with amorphous silicates. The alkali silicates that can be used in the agents as builders preferably have a molar ratio of alkali oxide to $SiO_2$ of less than 0.95, in particular from 1:1.1 to 1:12, and may be present in amorphous or crystalline form. Preferred alkali silicates are sodium silicates, in particular amorphous sodium silicates having a $Na_2O:SiO_2$ molar ratio of from 1:2 to 1:2.8. Such amorphous alkali silicates are commercially available under the name Portil®, for example. Such silicates having a molar ratio of $Na_2O:SiO_2$ of from 1:1.9 to 1:2.8 are preferably added during production as a solid and not in the form of a solution. Preferably used as crystalline silicates, which may be present alone or in a mixture with amorphous silicates, are crystalline phyllosilicates of general formula $Na_2Si_xO_{2x+1}.yH_2O$, where x, referred to as the modulus, is a number from 1.9 to 4, y is a number from 0 to 20, and preferred values for x are 2, 3 or 4. Preferred crystalline phyllosilicates are those in which x in the stated general formula assumes the values 2 or 3. Both ß and δ-sodium disilicates ($Na_2Si_2O_5.yH_2O$) are particularly preferred. Practically water-free crystalline alkali silicates which have the above general formula, in which x is a number from 1.9 to 2.1, and which are prepared from amorphous alkali silicates may also be used in the agents described herein. In a further preferred embodiment of the agents according to the invention, a crystalline sodium phyllosilicate having a modulus of from 2 to 3, as can be prepared from sand and soda, is used. Crystalline sodium silicates having a modulus in the range of from 1.9 to 3.5 are used in a further preferred embodiment of washing agents. The alkalisilicate content thereof is preferably from 1 wt. % to 50 wt. %, and in particular from 5 wt. % to 35 wt. %, based on the water-free active substance. If alkali aluminosilicate, in particular zeolite, is also provided as an additional builder substance, the alkali silicate content is preferably from 1 wt. % to 15 wt. %, and in particular from 2 wt. % to 8 wt. %, based on the water-free active substance. The weight ratio of aluminosilicate to silicate, based in each case on water-free active substances, is preferably from 4:1 to 10:1. In agents containing both amorphous and crystalline alkali silicates, the weight ratio of amorphous alkali silicate to crystalline alkali silicate is preferably from 1:2 to 2:1 and in particular from 1:1 to 2:1.

In addition to or as an alternative to the mentioned inorganic builder, further water-soluble or water-insoluble inorganic substances may also be contained together therewith in the agents or may be used in methods according to the invention. In this context, alkali carbonates, alkali hydrogen carbonates and alkali sulfates, and mixtures thereof, are suitable. Additional inorganic material of this kind may be present in amounts of up to 70 wt. %.

In various embodiments, carbonate(s) and/or hydrogen carbonate(s), preferably alkali carbonate(s), particularly preferably sodium carbonate, can be used in amounts of from 2 to 50 wt. %, preferably from 5 to 40 wt. %, and in particular from 7.5 to 30 wt. %, based in each case on the weight of the dishwashing detergent.

The dishwashing detergents according to the invention may further contain a sulfopolymer as a further builder. The weight proportion of the sulfopolymer with respect to the total weight of the dishwashing detergent according to the invention is preferably from 0.1 to 20 wt. %, in particular from 0.5 to 18 wt. %, particularly preferably from 1.0 to 15 wt. %, in particular from 4 to 14 wt. %, above all from 6 to 12 wt. %. The sulfopolymer is usually used in the form of an aqueous solution, the aqueous solutions typically containing from 20 to 70 wt. %, in particular from 30 to 50 wt. %, preferably approximately from 35 to 40 wt. %, of sulfopolymers.

A copolymeric polysulfonate, preferably a hydrophobically modified copolymeric polysulfonate, is preferably used as the sulfopolymer. The copolymers can have two, three, four or more different monomer units. Preferred copolymeric polysulfonates contain, in addition to sulfonic acid group-containing monomer(s), at least one monomer from the group of unsaturated carboxylic acids.

As unsaturated carboxylic acid(s), unsaturated carboxylic acids of the formula $R^1(R^2)C{=}C(R^3)COOH$ are particularly preferably used, in which $R^1$ to $R^3$ represent, independently of one another, —H, —$CH_3$, a straight-chain or branched saturated alkyl functional group having 2 to 12 carbon atoms, a straight-chain or branched, mono or polyunsaturated alkenyl functional group having 2 to 12 carbon atoms, where —$NH_2$, —OH, or —COOH substituted alkyl or alkenyl functional groups are as defined above, or represent —COOH or —$COOR^4$, where $R^4$ is a saturated or unsaturated, straight-chain or branched hydrocarbon functional group having 1 to 12 carbon atoms.

Particularly preferred unsaturated carboxylic acids are acrylic acid, methacrylic acid, ethacrylic acid, α-chloroacrylic acid, α-cyanoacrylic acid, crotonic acid, α-phenylacrylic acid, maleic acid, maleic anhydride, fumaric acid, itaconic acid, citraconic acid, methylenemalonic acid, sorbic acid, cinnamic acid, or mixtures thereof. Unsaturated dicarboxylic acids can obviously also be used.

The preferred sulfonic acid group-containing monomers are those of formula $$R^5(R^6)C{=}C(R^7)—X—SO_3H$$

in which $R^5$ to $R^7$ represent, independently of one another, —H, —$CH_3$, a straight-chain or branched saturated alkyl functional group having 2 to 12 carbon atoms, a straight-chain or branched, mono or polyunsaturated alkenyl functional group having 2 to 12 carbon atoms, comprising —$NH_2$, —OH, or —COOH substituted alkyl or alkenyl functional groups, or —COOH or —$COOR^4$, where $R^4$ is a saturated or unsaturated, straight-chain or branched hydrocarbon functional group having 1 to 12 carbon atoms, and X represents an optionally present spacer group that is selected from —$(CH_2)_n$— where n=0 to 4, —COO—$(CH_2)_k$— where k=1 to 6, —C(O)—NH—$C(CH_3)_2$—, —C(O)—NH—$C(CH_3)_2$—$CH_2$— and —C(O)—NH—$CH(CH_3)$—$CH_2$—.

Among said monomers, the preferred are those of the formulas $$H_2C{=}CH—X—SO_3H$$

$$H_2C{=}C(CH_3)—X—SO_3H$$

$$HO_3S—X—(R^6)C{=}C(R^7)—X—SO_3H,$$

in which $R^6$ and $R^7$ are selected, independently of one another, from —H, —$CH_3$, —$CH_2CH_3$, —$CH_2CH_2CH_3$, and —$CH(CH_3)_2$, and X represents an optionally present spacer group that is selected from —$(CH_2)_n$— where n=0 to 4, —COO—$(CH_2)_k$— where k=1 to 6, —C(O)—NH—$C(CH_3)_2$—, —C(O)—NH—$C(CH_3)_2$—$CH_2$— and —C(O)—NH—$CH(CH_3)$—$CH_2$—.

Particularly preferred sulfonic acid group-containing monomers are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allyl sulfonic acid, methallyl sulfonic acid, allyloxybenzene sulfonic acid, methallyloxybenzene sulfonic acid, 2-hydroxy-3-(2-propenyloxy)propanesulfnic acid, 2-methyl-2-propene-1-sulfonic acid, styrenesulfonic acid, vinylsulfonic acid, 3-sulfopropylacrylate, 3-sulfopropylmethacrylate, sulfomethacrylamide, sulfomethylmethacrylamide, and mixtures of the above acids or the water-soluble salts thereof.

The sulfonic acid groups may be present in the polymers in a completely or partially neutralized form, i.e. the acidic hydrogen atom of the sulfonic acid group can be exchanged in some or all of the sulfonic acid groups for metal ions, preferably alkali metal ions, and in particular for sodium ions. The use of partially or fully neutralized sulfonic acid group-containing copolymers is preferred according to the invention.

In copolymers that only contain carboxylic acid group-containing monomers and sulfonic acid group-containing monomers, the monomer distribution of the copolymers that are preferably used is from 5 to 95 wt. %, particularly preferably the proportion of sulfonic acid group-containing monomers is from 50 to 90 wt. %, and the proportion of carboxylic acid group-containing monomers is from 10 to 50 wt. %, with the monomers being preferably selected from among those mentioned above.

The molar mass of the sulfo-copolymers that are preferably used can be varied in order to adapt the properties of the polymers to the desired use. Preferred dishwashing detergents are characterized in that the copolymers have molar masses of from 2,000 to 200,000 $gmol^{-1}$, preferably from 4,000 to 25,000 $gmol^{-1}$, and in particular from 5,000 to 15,000 $gmol^{-1}$.

In a preferred embodiment, the washing or cleaning agent according to the invention contains at least one sulfopolymer as a builder, the solid, powder or granular phase in particular containing the sulfopolymer.

In various embodiments, other polymers can be used in the agents of the invention. The group of suitable polymers includes, in particular, washing or cleaning-active polymers, for example clear rinse polymers and/or polymers which act as softeners. In general, cationic, anionic and amphoteric polymers can be used in automatic dishwashing detergents, in addition to non-ionic polymers. The sulfo(co)polymers described above are, for example, anionic polymers.

Within the meaning of the present invention, "amphoteric polymers" also have in the polymer chain, in addition to a positively charged group, negatively charged groups or monomer units. These groups may be, for example, carboxylic acids, sulfonic acids or phosphonic acids.

Preferred polymers which can be used originate from the group of alkylacrylamide/acrylic acid copolymers, alkylacrylamide/methacrylic acid copolymers, alkylacrylamide/methylmethacrylic acid copolymers, alkylacrylamide/acrylic acid/alkylaminoalkyl(meth)acrylic acid copolymers, alkylacrylamide/methacrylic acid/alkylaminoalkyl(meth)acrylic acid copolymers, alkylacrylamide/methylmethacrylic acid/alkylaminoalkyl(meth) acrylic acid copolymers, alkylacrylamide/alkymethacrylate/alkylaminoethylmethacrylate/alkylmethacrylate copolymers, and copolymers of unsaturated carboxylic acids, cationically derivatized unsaturated carboxylic acids and optionally further ionic or non-ionic monomers.

Other polymers that can be used originate from the group of acrylamidoalkyltrialkylammonium chloride/acrylic acid copolymers and the alkali and ammonium salts thereof, acrylamidoalkyltrialkylammonium chloride/methacrylic acid copolymers and the alkali and ammonium salts thereof, and methacrylethylbetaine/methacrylate copolymers.

In various embodiments, the aforementioned organic and/or inorganic builder substances are preferably contained in the at least one solid phase of the agent according to the invention.

The amounts given above for the described surfactants and builders usually refer to the amounts that are used when the particular surfactant or the particular builder is used alone, unless explicitly stated otherwise. Therefore, it will readily be understood that, when using multiple surfactants or builders, the specified amounts are adjusted accordingly.

In preferred embodiments, the agents of the present invention contain one or more enzymes. The enzyme or enzymes used may be present in an enzyme preparation or enzyme composition.

All enzymes known from the prior art that can develop catalytic activity in a washing or cleaning agent are suitable as the enzyme, including, but not being limited to, proteases, amylases, lipases, cellulases, hemicellulases, mannanases, pectin-cleaving enzymes, tannases, xylanases, xanthanases, ß-glucosidases, carrageenanases, perhydrolases, oxidases, oxidoreductases and mixtures thereof. In a preferred embodiment, the at least one enzyme is selected from the group consisting of proteases, amylases, lipases, cellulases and mixtures thereof. These enzymes are in principle of natural origin; starting from the natural molecules, variants that have however been improved for use in washing or cleaning agents are available, which are preferably used accordingly. The agents preferably contain enzymes in total amounts of from $1\times10^{-6}$ to 5 wt. %, based on the active protein. The protein concentration can be determined using known methods, for example the BCA method or the Biuret method.

In preferred embodiments of the invention, the enzyme is contained in the agent according to the invention in an amount of from 0.01 to 10 wt. %, preferably from 0.01 to 5 wt. %, based on the total weight of the agent.

The protein concentration can be determined using known methods, for example the BCA method (bicinchoninic acid; 2,2'-bichinolyl-4,4'-dicarboxylic acid) or the Biuret method. The active protein concentration is determined, in this respect, by titrating the active centers using a suitable irreversible inhibitor (for proteases, phenylmethylsulfonyl fluoride (PMSF), for example), and determining the residual activity (cf. M. Bender et al., J. Am. Chem. Soc. 88, 24 (1966), pages 5890-5913).

Proteases are among the industrially most significant enzymes of all. They cause the breakdown of protein-containing stains on the item to be cleaned. Of these proteases, subtilisin-type proteases (subtilases, subtilopeptidases, EC 3.4.21.62) are particularly significant, which proteases are serine proteases owing to the catalytically active amino acids. Said proteases act as non-specific endopeptidases and hydrolyze any acid amide bonds that are within peptides or proteins. Their pH optimum is usually in the highly alkaline range. Subtilases are formed naturally by microorganisms. Of these, subtilisins that are formed by and secreted from *Bacillus* species should be mentioned in particular as the most significant group within the subtilases.

Examples of the subtilisin-type proteases that are preferably used in washing and dishwashing detergents are the subtilisins BPN' and Carlsberg, protease PB92, subtilisins 147 and 309, protease from *Bacillus lentus*, in particular from *Bacillus lentus* DSM 5483, subtilisin DY, the enzymes thermitase, proteinase K and proteases TW3 and TW7, which belong to the subtilases but no longer to the subtilisins in the narrower sense, and variants of the mentioned proteases which have an altered amino-acid sequence by comparison with the starting protease. Proteases are altered, selectively or randomly, by methods known from the prior art, and are thereby optimized for use in washing and dishwashing detergents, for example. These methods include point, deletion or insertion mutagenesis, or fusion with other proteins or protein parts. Therefore, variants that are appropriately optimized are known for most of the proteases known from the prior art.

Examples of amylases that can be used are α-amylases from *Bacillus licheniformis*, from *B. amyloliquefaciens*, from *B. stearothermophilus*, from *Aspergillus niger*, and *A. oryzae*, as well as the developments of the above-mentioned amylases that have been improved for use in dishwashing detergents. Furthermore, the α-amylase from *Bacillus* sp. A 7-7 (DSM 12368) and the cyclodextrin glucanotransferase (CGTase) from *B. agaradherens* (DSM 9948) should be highlighted for this purpose.

Furthermore, lipases or cutinases can be used, particularly due to their triglyceride-cleaving activities, but also in order to produce peracids in situ from suitable precursors. These include, for example, the lipases that can originally be obtained from *Humicola lanuginosa* (*Thermomyces lanuginosus*) and those that have been developed, particularly those with the amino acid exchange D96L.

Furthermore, enzymes may be used which can be grouped together under the term "hemicellulases." These include, for example, mannanases, xanthan lyases, pectin lyases (=pectinases), pectinesterases, pectate lyases, xyloglucanases (=xylanases), pullulanases, and β-glucanases. Among the examples mentioned last, licheninases in particular should be mentioned.

In order to increase the bleaching effect, oxidoreductases such as oxidases, oxygenases, catalases, peroxidases such as halo, chloro, bromo, lignin, glucose, or manganese peroxidases, dioxygenases or laccases (phenoloxidases, polyphenoloxidases) can be used. Advantageously, organic, particularly preferably aromatic compounds that interact with the enzymes are additionally added in order to enhance the activity of the relevant oxidoreductases (enhancers) or, in the event of greatly differing redox potentials, to ensure the flow of electrons between the oxidizing enzymes and the contaminants (mediators).

The agent according to the invention preferably contains at least one enzyme selected from the group comprising proteases, amylases, lipases, hemicellulases, cellulases, β-glucanases, perhydrolases and oxidoreductases.

An enzyme can be protected, in particular during storage, against damage, for example inactivation, denaturing, or decomposition caused, for example, by physical influences, oxidation, or proteolytic cleavage. When the proteins and/or enzymes are obtained microbially, it is particularly preferred that proteolysis be inhibited, particularly if the agents also contain proteases. Dishwashing detergents can contain for this purpose stabilizers; the provision of agents of this kind constitutes a preferred embodiment of the present invention.

In the agents described herein, the enzymes that can be used can also be formulated together with accompanying substances, from fermentation for example. In liquid formulations, the enzymes are preferably used as liquid enzyme formulation(s).

The enzymes are generally not made available in the form of the pure protein, but rather in the form of stabilized, storable and transportable preparations. These ready-made preparations include, for example, the solid preparations obtained by means of granulation, extrusion or lyophilization or, particularly in the case of liquid or gel agents, solutions of the enzymes which are advantageously maximally concentrated, have a low water content, and/or are supplemented with stabilizers or other auxiliary agents.

Alternatively, for both solid and liquid dosage forms, the enzymes can be encapsulated, for example by means of spray-drying or extrusion of the enzyme solution together with a preferably natural polymer or in the form of capsules, for example those in which the enzymes are enclosed in a set gel, or in those of the core-shell type in which an enzyme-containing core is coated with a water, air, and/or chemical-impermeable protective layer. In the case of overlaid layers, other active ingredients, such as stabilizers, emulsifiers, pigments, bleaching agents, or dyes, can be additionally applied. Capsules of this kind are applied using inherently known methods, for example by means of shaking or roll granulation or in fluidized bed processes. Granulates of this kind are advantageously low in dust, for example due to the application of polymeric film-formers, and stable in storage due to the coating.

Moreover, it is possible to formulate two or more enzymes together, so that a single granulate has several enzyme activities.

As can be seen from the preceding remarks, the enzyme protein forms only a fraction of the total weight of conventional enzyme preparations. Protease and/or amylase preparations that are preferably used contain between 0.1 and 40 wt. %, preferably between 0.2 and 30 wt. %, particularly preferably between 0.4 and 20 wt. %, and in particular between 0.8 and 10 wt. %, of the enzyme protein.

Dishwashing detergents which contain from 0.1 to 12 wt. %, preferably from 0.2 to 10 wt. % and in particular from 0.5 to 8 wt. %, of enzyme preparations are particularly preferred.

In various embodiments, the agent according to the invention can comprise one or more enzyme stabilizers.

The compositions described herein may also include enzyme stabilizers. One group of stabilizers are reversible protease inhibitors. Benzamidine hydrochloride, borax, boric acids, boronic acids or the salts or esters thereof are often used, in particular derivatives having aromatic groups, for example ortho-substituted, meta-substituted or para-substituted phenyl boronic acids, in particular 4-formylphenyl boronic acid, or the salts or esters of said compounds. Peptide aldehydes, i.e. oligopeptides having a reduced C-terminus, in particular those consisting of 2 to 50 monomers, are also used for this purpose. Peptide reversible protease inhibitors include, inter alia, ovomucoid and leupeptin. Specific, reversible peptide inhibitors for the protease subtilisin and fusion proteins consisting of proteases and specific peptide inhibitors are also suitable for this purpose.

Other enzyme stabilizers are amino alcohols, such as mono, di and tri ethanol and propanolamine and mixtures thereof, aliphatic carboxylic acids up to $C_{12}$, such as succinic acid, other dicarboxylic acids or salts of the mentioned acids. End-capped fatty acid amide alkoxylates are also suitable for this purpose. Further enzyme stabilizers are known to a person skilled in the art from the prior art.

In various embodiments, the at least one enzyme is preferably contained in the at least one solid phase of the agent according to the invention.

Within the context of the present invention, it is possible to use individual odorant compounds, such as synthetic products of the ester, ether, aldehyde, ketone, alcohol and hydrocarbon types, as perfume oils or fragrances. Preferably, however, mixtures of different odorants are used, which together produce an appealing fragrance note. Perfume oils of this kind can also contain natural odorant mixtures, as are obtainable from plant sources, e.g., pine, citrus, jasmine, patchouli, rose or ylang-ylang oil.

Solvents which are suitable for the compositions used according to the invention are generally water-miscible organic solvents, such as, but without limitation, monohydric or polyhydric alcohols, alkanolamines or glycol ethers. Preferably, the solvents are selected from ethanol, n-propanol, i-propanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butyl ether, di-n-octyl ether, and mixtures of these solvents. Glycerol and 1,2-propanediol are particularly preferred. In various embodiments, the washing or cleaning agent may contain organic solvents of this kind in amounts of up to at most 50 wt. %, preferably up to 20 wt. %, based on the total weight of the composition.

The washing and cleaning agents described herein are preferably prefabricated in the form of a multi-compartment sachet. In this case, the liquid and the solid phase are in different compartments of the sachet. Metering units prefabricated in this way preferably comprise the necessary amount of washing or cleaning-active substances for a cleaning cycle. Preferred metering units have a weight of between 12 and 35 g, preferably between 14 and 29 g and in particular between 16 and 26 g. The volume of the aforementioned metering units and their three-dimensional shape are particularly preferably selected such that metering of the prefabricated units is ensured via the metering chamber of a washing machine or dishwasher. The volume of the metering unit is therefore preferably between 10 and 35 ml, more preferably between 14 and 25 ml.

The washing and cleaning agents, in particular the prefabricated metering units, particularly preferably have a water-soluble wrapping. The terms "wrapping" and "packaging" should be understood to be the same, unless otherwise stated in the context.

The water-soluble wrapping is preferably made of a water-soluble film material which is selected from the group consisting of polymers or polymer mixtures. The wrapping may be formed of one, two or more layers of the water-soluble film material. The water-soluble film material of the first layer and the further layers, if present, may be the same or different. Particularly preferred are films which, for example, can be glued and/or sealed to form packaging, such as tubes or pillow-like packaging, after being filled with an agent.

According to the invention, the water-soluble packaging has at least two or more compartments, in each of which one of the at least two different phases, as defined herein, is contained. In particular, a first compartment comprises a liquid agent and a second compartment comprises a solid agent. The amount of agent preferably corresponds to the full or half dose needed for a washing or cleaning cycle.

The washing or cleaning agent according to the invention can be characterized in that it is in a water-insoluble, water-soluble or water-disintegrable packaging, in particular in a film containing polyvinyl alcohol, the at least one liquid phase and the at least one solid phase being in particular separated from one another by means of the water-soluble or water-dispersible packaging, in particular the film containing polyvinyl alcohol. The washing or cleaning agent according to the invention can be characterized in that it is in a water-insoluble, water-soluble or water-disintegrable packaging, in particular in a film containing polyvinyl alcohol, the at least one gel or pasty phase and the at least one solid phase being located in the same compartment of the water-soluble or water-dispersible packaging, in particular the film containing polyvinyl alcohol. Water-soluble or water-disintegrable packaging is particularly preferred.

It is preferable for the water-soluble wrapping to contain polyvinyl alcohol or a polyvinyl alcohol copolymer. Water-soluble wrappings containing polyvinyl alcohol or a polyvinyl alcohol copolymer have a good stability with a sufficiently high water solubility, in particular cold water solubility.

Suitable water-soluble films for producing the water-soluble wrapping are preferably based on a polyvinyl alcohol or a polyvinyl alcohol copolymer of which the molecular weight is in the range of from 10,000 to 1,000,000 $gmol^{-1}$, preferably from 20,000 to 500,000 $gmol^{-1}$, particularly preferably from 30,000 to 100,000 $gmol^{-1}$, and in particular from 40,000 to 80,000 $gmol^{-1}$.

Polyvinyl alcohol is usually prepared by hydrolysis of polyvinyl acetate, since the direct synthesis route is not possible. The same applies to polyvinyl alcohol copolymers, which are correspondingly prepared from polyvinyl acetate copolymers. It is preferable for at least one layer of the water-soluble wrapping to comprise a polyvinyl alcohol of which the degree of hydrolysis is from 70 to 100 mol. %, preferably from 80 to 90 mol. %, particularly preferably from 81 to 89 mol. %, and in particular from 82 to 88 mol. %.

In other embodiments, the degree of polyvinyl alcohol hydrolysis is at least 85 mol. %, preferably at least 88 mol. %, even more preferably at least 90 mol. %, very particularly preferably at least 98 mol. %.

Polyvinyl alcohol is strictly speaking a copolymer of vinyl alcohol and vinyl acetate, the monomer ratio in the polymer depending on the degree of hydrolysis of the vinyl acetate. However, in the nomenclature used herein, the polyvinyl alcohol polymer is considered a homopolymer. The term "copolymer" or "terpolymer" is used when, in addition to the vinyl alcohol and vinyl acetate, other monomers are contained in the polymer.

If the degree of polyvinyl alcohol hydrolysis is 85 mol. % or more, preferably 88 mol. % or more, more preferably 90 mol % or more, the polyvinyl alcohol is preferably a copolymer.

The term "polyvinyl alcohol" covers mixtures of polyvinyl alcohol and polyvinyl alcohol copolymers. Copolymers may include 2-acrylamido-2-methylpropanesulfonic acid (AMPS). Also included are terpolymers of polyvinyl alcohol. Preferably, the polyvinyl alcohol is a copolymer comprising AMPS.

If copolymers or terpolymers are used, the degree of polyvinyl alcohol hydrolysis is usually at least 90 mol. %. Preferably, the degree of hydrolysis is at least 95 mol. %, more preferably at least 98 mol. %.

Also, the polyvinyl alcohol may comprise a mixture of polyvinyl alcohol and a monomer selected from the list consisting of 2-aerylamido-1-methylpropanesulfonic acid, 2-methylacrylamido-2-methylpropanesulfonic acid and alkali metal salts thereof.

The content of sulfonic acid group units in the modified polyvinyl alcohol is preferably from 0.1 to 20 mol. %, more preferably from 0.5 to 10 mol. %, most preferably from 1 to 5 mol. %.

The mechanical properties as a water-soluble film are also important. Sufficient strength and flexibility of the film are necessary, in particular in the case of a small thickness of from 10 to 100 μm. Therefore, the degree of polymerization averaged over the viscosity (referred to herein as the degree of polymerization) of the modified PVA is preferably 300 to 10,000, more preferably 500 to 8,000, even more preferably 900 to 2,000, still more preferably 1,000 to 1,800. If the degree of polymerization is less than 300, the strength of the film becomes lower. If the degree of polymerization is more than 10,000, the viscosity of the solution during the production of the film becomes so high that processability is lowered.

The degree of polymerization averaged over the viscosity can be calculated by measuring the Staudinger factor [η] (dl/g). The Staudinger factor is determined at 30° C. in aqueous NaCl solution (1 M) using a capillary viscometer. The viscosity-averaged degree of polymerization for polyvinyl alcohols is approximately calculated using $Pv=([\eta]\times 10^4/8.33)^{1/0.62}$, in which case for the Mark Houwink parameter $K=8.33\times10^{-4}$ and a=0.62.

Synthesis can be carried out, for example, as follows. A methanolic solution of sodium hydroxide is added to a methanolic solution of a copolymer prepared by copolymerization of vinyl acetate and sodium acrylamido-2-methylpropanesulfonate in methanol. This hydrolyzes the copolymer and results in a modified PVA having a sulfonic acid group. The modified PVA obtained in this way very particularly preferably has a degree of polymerization of 1,300, a degree of hydrolysis of 98 mol. % and a sulfonic acid group content of 1.5 mol. %.

Also, the polyvinyl alcohol may be present as a terpolymer.

In some embodiments, the second film comprises a copolymer of polyvinyl alcohol having from 0 to 10 mol. % of remaining acetate and from 1 to 6 mol. % of a non-hydrolizable anionic comonomer, selected from the group consisting of acrylic acid, methacrylic acid, cis-2-butenoic acid, 3-butenoic acid, cinnamic acid, phenylcinnamic acid, pentenoic acid, methylenemalonic acid, acrylamide, maleic acid, itaconic acid, and the alkali metal and ammonium salts thereof.

The vinyl acetate-co-itaconic acid copolymer is prepared under nitrogen in methanol as a solvent using 2,2'-azobis (isobutyronitrile) (AIBN) as an initiator. Alcoholysis of this copolymer is carried out in methanolic sodium hydroxide solution, and the recovered vinyl alcohol-co-itaconic acid (sodium salt) copolymer is ground, washed to remove residual sodium acetate, and dried. The preferred degree of polymerization of the vinyl alcohol-co-itaconic acid (sodium salt) copolymer is preferably such that the viscosity of a freshly prepared 4% aqueous solution at 20° C. is in the range of approximately 5 to approximately 45 MPa·s (cps). More preferably, the viscosity is in the range of from 11 to 30 mPas, and particularly preferably in the range of from 15 to 25 mPas.

The viscosities described herein are determined for a freshly prepared 4% aqueous solution at 20° C. using a Brookfield LV viscometer with a UL adapter according to EN ISO 15023-2:2006 Appendix E Brookfield Test Method.

The preferred level of incorporation of itaconic acid comonomer in the vinyl alcohol-co-itaconic acid (sodium salt) copolymer, expressed as a mole percentage, is in the range of from approximately 1.5 to approximately 11 mol. %. More preferably, the degree of incorporation is in the range of from 2.5 to 8.5 mol. %, and particularly preferably in the range of from 4 to 6 mol. %. The preferred level of hydrolysis of the vinyl alcohol-co-itaconic acid (sodium salt) copolymer of the present invention, expressed as a percentage of vinyl acetate units converted into vinyl alcohol units, is in the range of from approximately 98 to approximately 100%.

It is preferred, however, that the polyvinyl alcohol polymer is a copolymer having a sulfonate monomer, preferably AMPS, or is a terpolymer having AMPS and a further monomer.

It has been found that the sulfonic acid monomers acting as stronger acids than carboxylic acid monomers react less strongly with the hydroxy groups of the vinyl alcohol monomers in the polymer. Thus, the water solubility of the resulting polymers is more independent of pH changes and inorganic salts.

A polymer selected from the group comprising (meth) acrylic acid-containing (co)polymers, polyacrylamides, oxazoline polymers, polystyrene sulfonates, polyurethanes, polyesters, polyethers, polylactic acid or mixtures of the above polymers may additionally be added to a film material which contains polyvinyl alcohol and is suitable for producing the water-soluble wrapping. Preferred additional polymers are polylactic acids.

Preferred polyvinyl alcohol copolymers include, in addition to vinyl alcohol, dicarboxylic acids, as further monomers. Suitable dicarboxylic acids are itaconic acid and mixtures thereof, itaconic acid being preferred.

Polyvinyl alcohol copolymers which are also preferred include, in addition to vinyl alcohol, an ethylenically unsaturated carboxylic acid, the salts thereof or the esters thereof. Polyvinyl alcohol copolymers of this kind particularly preferably contain, in addition to vinyl alcohol, acrylic acid, methacrylic acid, acrylic acid esters, methacrylic acid esters or mixtures thereof.

It may be preferable for the film material to contain further additives. The film material may contain, for example, plasticizers such as dipropylene glycol, ethylene glycol, diethylene glycol, propylene glycol, glycerol, sorbitol, mannitol or mixtures thereof. Further additives include, for example, release aids, fillers, crosslinking agents, surfactants, antioxidants, UV absorbers, antiblocking agents, anti-sticking agents or mixtures thereof.

Suitable water-soluble films for use in the water-soluble wrappings of the water-soluble packaging according to the invention are films marketed by the company MonoSol LLC, for example under the name M8630, M8315, M8720, C8400 or M8900. Other suitable films include films named Solublon® PT, Solublon® GA, Solublon® KC or Solublon® KL from Aicello Chemical Europe GmbH or the films VFHP from Kuraray.

The invention also relates to the corresponding use of the washing or cleaning agent according to the invention. The invention also relates to a textile washing or dishwashing method, in particular an automatic dishwashing method, in which a washing or cleaning agent according to the invention is used. The present invention therefore also relates to a method for cleaning textiles or hard surfaces, such as dishes, in a washing machine or dishwasher, in which the agent according to the invention is dispensed into the interior of a washing machine or dishwasher while a washing or dishwashing program is running, before the main rinsing or washing cycle begins or during the main rinsing or washing cycle. The agent according to the invention can be dispensed or introduced into the interior of the washing machine or dishwasher manually, but the agent is preferably metered into the interior of the washing machine or dishwasher by means of the metering chamber.

Finally, the present invention is also directed to the particles described herein. As described above, the particles according to the invention comprise at least one bleach activator, the at least one bleach activator being compounded with at least one complexing agent. The complexing agent and/or the bleach activator are preferably defined and compounded as already described above in connection with the agents according to the invention and can also be prepared in the manner described above. In various embodiments, the particles consist substantially or exclusively of bleach activator and complexing agent, preferably in the above-mentioned ratios, i.e. the amount of the complexing agent is from 5 to 30 wt. % of the total weight of the particle.

In various embodiments, the at least one complexing agent is selected from the group consisting of the sodium salt of DTPMP, HEDP, MGDA or GLDA.

In some embodiments, the at least one complexing agent is selected from the group consisting of the sodium salt of DTPMP and HEDP. In various embodiments, the at least one bleach activator is TAED.

In various embodiments, the particles described herein are distinguished by being approximately spherical.

In various embodiments, the particles described herein are also distinguished in that the average particle diameter of the particles is in the range of from 300 to 1000 μm.

The embodiments described in the context of the agents according to the invention are readily transferable to the methods and uses according to the invention, and vice versa.

The washing and cleaning agents according to the invention containing the particles described herein are distinguished in that they are storage stable and, even after a relatively long period of time, there is no discoloration or odor change either in the particles themselves or in the washing or cleaning agent in which they are contained. In addition, it can be seen that the agents have good washing or cleaning performance even after long periods of storage, especially when they contain bleaching agents. Thus, the agent remains visually attractive over a long period of time and has improved cleaning or washing performance.

PRACTICAL EXAMPLES

Example 1

TAED granules from Warwick were compounded with a DTPMP phosphonate solution (diethylenetriamine pentamethylene phosphonic acid heptasodium salt, Dequest 2066, from thermPhos) in a Glatt AGT 200 fluidized bed. The fluidized bed temperature was selected such that there was no agglomeration of the TAED granules. The resulting TAED-DTPMP compound had a DTPMP content of 13.0 wt. %.

Two powder mixtures A1-A3 were prepared in a tumble mixer by dry mixing the individual granules.

| Chemical name | A1 wt. % | A2 wt. % | A3 wt. % |
|---|---|---|---|
| Na percarbonate | 36 | 36 | 36 |
| TAED | | 12 | 12 |
| TAED/DTPMP compound | 12 | — | — |
| HEDP | — | — | 4 |
| Carboxymethylcellulose | 6.5 | 6.5 | 6.5 |
| Soda | 10.0 | 10 | 5 |
| Na silicate | 12.0 | 12 | 12 |
| Enzyme mixture (protease, mannanase, amylase) | 13 | 13 | 13 |
| Soap | 3 | 3 | 3 |

All values in wt. % AS: active substance

All Values in Wt. % AS: Active Substance

All ingredients specified, except for the enzyme mixture, as the active substance.

A1 contained the TAED complexing agent compound according to the invention. A2 did not contain a complexing agent and A3 was a composition in which a complexing agent was added separately as granules. 1-hydroxyethane-1,1-diphosphonic acid tetrasodium salt was used as HEPD.

A liquid phase of composition B was prepared.

| Ingredient | wt. % |
|---|---|
| Propylene glycol | 8.2 |
| Glycerol | 10.5 |
| Optical brightener | 0.6 |
| Linear alkylbenzene sulfonate | 22.0 |
| C13/15 oxo alcohol having 8 EO | 24.0 |
| Monoethanolamine for saponification | 6.0 |
| C12-18 soap | 7.5 |
| Polyethylene imine polymer | 6.0 |
| DTPMP | 0.7 |
| Ethanol | 3.0 |
| Soil release polymer | 1.4 |
| Perfume | 1.7 |
| Dye | 0.01 |
| Water | 8.39 |

The formulation contained 8.39 wt. % water from addition and raw materials. All ingredients specified as the active substance. Diethylenetriamine pentamethylene phosphonic acid heptasodium salt was used as DTPMP.

Example 2

Production of a dual-compartment sachet with the film Monosol M8720, 88 μm film thickness, in a dual-compartment cavity (deep drawing temperature 102° C., sealing temperature 150° C.). 8.5 g of each powder mixture A1-A3 was packaged in one compartment, with 16.5 g of liquid B in another compartment.

The produced sachets were stored at 40° C. in a closed screw-capped glass container. After storage, a sample was taken from the powder compartments and supplied to a TAM (Thermal Activity Monitor). The sample was stored isothermally at 40° C. and the heat flow from this sample was determined over time. The bleaching components underwent exothermic decomposition reactions. The greater the heat flow of the sample, the less stable the bleaching components. For better comparability, the heat flow was measured after 48 hours of storage. Likewise, a fresh, powder mixture not packaged as a sachet was examined in the TAM.

| | A1 | A2 | A3 |
|---|---|---|---|
| TAM fresh powder [μw/g] | 11.7 | 13.0 | 14.0 |
| TAM of a powder after 7 days storage in a sachet at 40° C. [μw/g] | 22.5 | 58.1 | 56.8 |

Composition A1 according to the invention had the same stability in terms of freshness as the comparative mixtures A2 and A3. After storage, the stability of mixture A1 was significantly higher than that of the comparative mixtures without a complexing agent and with a mixed-in complexing agent.

Example 3: Preparation of Bleach Activators with Alternative Complexing Agents TAED granules from Warwick were compounded with a complexing agent solution in a Glatt fluidized bed. The fluidized bed temperature was selected such that there was no agglomeration of the TAED granules. In a first variant, MGDA (trisodium α-DL-alanine diacetate, Trilon M) or GLDA (tetrasodium-N,N-bis(carboxylatomethyl)-L-glutamate, Dissolvine) were used as complexing agents. The resulting TAED complexing agent compounds had a complexing agent content of 10.0 wt. %. In a second variant, MGDA (trisodium α-DL-alanine diacetate, Trilon M) and GLDA (tetrasodium-N,N,bis(carboxylatomethyl)-L-glutamate, Dissolvine) were used as complexing agents. The resulting TAED complexing agent compounds had a complexing agent content of 12.0 wt. %.

Example 4: Dishwashing Detergent Composition

| Raw material | Amount (wt. %) |
|---|---|
| Na citrate | 15.00-20.00 |
| Phosphonate (HEDP) | 2.50-7.50 |
| MGDA | 0.00-25.00 |
| Na disilicate | 5.00-35.00 |
| Soda | 12.50-25.00 |
| Na percarbonate | 10.00-15.00 |
| Bleach catalyst (Mn-based) | 0.02-0.50 |
| TAED* | 2.00-3.00** |
| Non-ionic surfactant 20-40 EO end-cap poss. | 2.50-10.00 |
| Polycarboxylate | 5.00-10.00 |
| Cationic copolymer | 0.25-0.75 |
| PVP (cross-linked) | 0.00-1.50 |
| Enzyme preparation (protease, amylase) | 2.00-8.00 |
| Benzotriazole (silver protection) | 0.00-0.50 |
| Perfume | 0.05-0.15 |
| Dye | 0.00-1.00 |
| Zn acetate | 0.10-0.30 |
| Na sulfate | 0.00-25.00 |
| Water | 0.00-1.50 |
| pH adjuster | 1.00-1.50 |
| Processing aids | 0.00-5.00 |

*TAED: tetraacetylethylenediamine

**amount of bleach activator TAED used, based on the total composition, used in the form of a TAED complexing agent compound

What is claimed is:

1. Particles comprising at least one bleach activator, characterized in that the at least one bleach activator is compounded with at least one complexing agent, characterized in that the particles have an average particle diameter in the range of 300-1000 μm.

2. Particles according to claim 1, characterized in that the at least one complexing agent is a complexing agent which binds Ca2+ at 20° C. at a calcium binding capacity mg CaO/g of at least 100.

3. Particles according to claim 1, characterized in that the at least one complexing agent is selected from the group consisting of phosphonates, aminocarboxylic acid salts and (polymeric) polycarboxylates and their corresponding acids.

4. Particles according to claim 1, characterized in that the at least one bleach activator is selected from the group consisting of polyacylated alkylenediamines, acylated triazine derivatives, acylated glycolurils, N-acylimides, and acylated phenolsulfonates.

5. Particles according to claim 1, characterized in that the coating amount of the at least one complexing agent on the at least one bleach activator is in the range of 5 wt. % to 25 wt. % based on the total weight of the compounded bleach activator.

6. Particles according to claim 1, characterized in that the at least one complexing agent is selected from the group consisting of the sodium salt of DTPMP, HEDP, MGDA and GLDA.

7. Particles according to claim 1, characterized in that the at least one bleach activator is TAED.

8. Particles according to claim 1, characterized in that the particles are approximately spherical.

9. A multiphase washing or cleaning agent, comprising at least one liquid, low-water to water-free phase and at least one solid, powder or granular phase, characterized in that the at least one solid, powder or granular phase contains at least one particle according to claim 1.

10. The washing or cleaning agent according to claim 9, characterized in that the amount of the at least one particle is in the range of 1 wt. % to 20 wt. % based on the total weight of the washing or cleaning agent.

11. The washing or cleaning agent according to claim 9, characterized in that the washing or cleaning agent contains at least one bleaching agent, in the solid, powder or granular phase.

12. The washing or cleaning agent according to claim 9, characterized in that the washing or cleaning agent contains at least one bleach catalyst, the bleach catalyst being selected from the group of bleach-enhancing transition metal salts and transition metal complexes.

13. The washing or cleaning agent according to claim 9, characterized in that the washing or cleaning agent contains at least one sulfopolymer as a builder, in the solid, powder or granular phase.

14. The washing or cleaning agent according to claim 9, characterized in that it is in a water-insoluble, water-soluble or water-disintegrable packaging, the at least one liquid phase and the at least one solid phase being separated from one another by means of the water-soluble or water-dispersible packaging.

15. The washing or cleaning agent according to claim 9, characterized in that it is in a water-insoluble, water-soluble or water-disintegrable packaging the at least one gel or pasty phase and the at least one solid phase being located in the same compartment of the water-soluble or water-dispersible packaging.

16. A method for washing or cleaning textiles or hard surfaces characterized in that, in at least one method step, a washing or cleaning agent according to claim 9 is used.

17. The at least one bleach catalyst according to claim 12, being selected from the group of transition metal complexes of manganese in oxidation stage II, III, IV or IV containing one or more macrocyclic ligand(s) having the donor functions N, NR, PR, O and/or S.

18. The at least one bleach catalyst according to claim 12, being selected from the group of macromolecular ligands 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (Me/Me-TACN) and 2-methyl-1,4,7-triazacyclononane (Me/TACN).

19. The at least one bleach catalyst according to claim 12, being selected from the group of ligands 1,4,7-trimethyl-1,4,7-triazacyclononane (Me-TACN) and 1,2,4,7-tetramethyl-1,4,7-triazacyclononane (Me/Me-TACN).

20. Particles of claim 1, characterized in that the amount of the at least one bleach activator in the compounded bleach activator is from 80 wt.% to 95 wt.% based on the total weight of the particle.

* * * * *